US007007615B2

(12) United States Patent
Grueneberg

(10) Patent No.: US 7,007,615 B2
(45) Date of Patent: Mar. 7, 2006

(54) COLLAPSIBLE SHELF UNIT

(75) Inventor: Bevan E. Grueneberg, Cedarburg, WI (US)

(73) Assignee: Menasha Corporation, Neenah, WI (US)

( * ) Notice: Subject to any disclaimer, the term of this patent is extended or adjusted under 35 U.S.C. 154(b) by 197 days.

(21) Appl. No.: 10/623,752

(22) Filed: Jul. 21, 2003

(65) Prior Publication Data

US 2004/0016375 A1 Jan. 29, 2004

Related U.S. Application Data

(63) Continuation-in-part of application No. 10/020,377, filed on Dec. 13, 2001, now Pat. No. 6,612,669.

(60) Provisional application No. 60/255,218, filed on Dec. 13, 2000.

(51) Int. Cl.
*A47B 43/02* (2006.01)

(52) U.S. Cl. ..... 108/165; 211/149; 312/259

(58) Field of Classification Search ..... 108/165, 108/180, 115, 153, 162; 312/259, 258, 262; 211/149, 195, 132.1, 85
See application file for complete search history.

(56) References Cited

U.S. PATENT DOCUMENTS

| | | | | |
|---|---|---|---|---|
| 3,139,192 | A * | 6/1964 | Maguire | 211/135 |
| 3,576,355 | A * | 4/1971 | Stone et al. | 312/258 |
| 4,271,766 | A | 6/1981 | Schmiedeler | |
| 4,582,003 | A * | 4/1986 | Valero | 108/179 |
| 4,854,246 | A * | 8/1989 | Belokin et al. | 108/162 |
| 5,193,466 | A | 3/1993 | Eder | |
| 5,273,169 | A | 12/1993 | Maglione | |
| 5,315,936 | A | 5/1994 | Smith | |
| 5,458,411 | A * | 10/1995 | Moss | 312/259 |
| 5,669,683 | A | 9/1997 | Moss et al. | |
| 5,678,492 | A * | 10/1997 | Pinkstone et al. | 108/165 |
| 5,706,959 | A * | 1/1998 | Smith | 248/174 |
| 5,826,732 | A * | 10/1998 | Ragsdale | 211/149 |
| 6,098,820 | A * | 8/2000 | Smith | 211/132.1 |
| 6,540,249 | B1 * | 4/2003 | King | 280/651 |
| 6,612,669 | B1 | 9/2003 | Grueneberg | |

FOREIGN PATENT DOCUMENTS

JP 2001-95659 A 4/2001

* cited by examiner

*Primary Examiner*—Jose V. Chen
(74) *Attorney, Agent, or Firm*—Quarles & Brady LLP

(57) ABSTRACT

A collapsible shelf unit has a three-sided frame made of a single sheet of foldable material and separate shelves which are hinged to the sides and rear of the frame so that the shelf unit can be collapsed to a substantially flat state by folding the shelves up against the rear of the back and folding the sides inward.

14 Claims, 12 Drawing Sheets

COLLAPSIBLE SHELF UNIT

CROSS-REFERENCE TO RELATED APPLICATION

This is a continuation in part of U.S. patent application Ser. No. 10/020,377 filed Dec. 13, 2001, now U.S. Pat. No. 6,612,669 which claims the benefit of U.S. Provisional Patent Application No. 60/255,218 filed Dec. 13, 2000.

STATEMENT CONCERNING FEDERALLY SPONSORED RESEARCH OR DEVELOPMENT

Not applicable.

FIELD OF THE INVENTION

This invention relates to shelf units, and in particular to a collapsible shelf unit which has particular application to delivery, set up and display of products in a store.

BACKGROUND OF THE INVENTION

Shelf space is in high demand in many retail outlets and therefore providers of products sometimes find it useful to provide the retail outlet with a shelf unit, along with the product being delivered. When the provider's products are delivered to the store, the delivery man may set up a shelf unit for the provider's products and place the provider's products on the shelves of the shelf unit. The shelf unit therefore must be highly transportable and easy to erect. It also must be attractive and sturdy to give the correct impression to the end purchaser users.

SUMMARY OF THE INVENTION

The invention provides a collapsible shelf unit which can be folded into a relatively thin, flat shape for shipping and storage, and can be easily erected to provide shelves to support product. The shelf unit of the invention is particularly adapted to be made out of corrugated paperboard materials, although other materials such as corrugated plastic or other sheet materials could be used.

A collapsible shelf unit of the invention includes a foldable frame having a back and opposite sides hingedly connected to the back at opposite side edges of the back, and separate shelves. Each shelf has a foldable base panel with opposite ears that are engaged in slots of the side panels of the frame. A shelf support panel is hingedly connected to the frame and may have tongues cut out of it extending from the hinge line and hingedly connected to the base panel. In one alternative, the tongues may extend from the rear edge (when folded) of a reinforcement panel and extend through slots at the rearward edge of the shelf support panel. The tongues may engage slots in the rear wall of the frame.

Preferably, one or more reinforcing panels are hingedly connected to the forward edge of the support panel to reinforce and increase the load carrying capacity of the support panel. Additionally, a reinforcing dowel may be inserted into the front edge of each shelf for additional reinforcement, and tabs may be provided along the side edges of one or more of the panels (shelf support or reinforcing) which can be folded in between the shelf support and reinforcing panels to secure the dowel at the front, between the two panels. With this construction, any number of shelves may be provided attached to the support frame, they may be of different depths and may be staggered in depth.

In its preferred form, a shelf unit of the invention is collapsed by first lifting each shelf support panel up against the back of the support frame. With the support panels out of the way, the opposite side panels of the frame may be folded inwardly, which is permitted by the base panel of each shelf folding upwardly toward the connected support panel by virtue of score lines that are provided at approximately a 45° angle to the back of the support frame as measured when the support frame is fully erect. The opposite sides of the frame are therefore able to be folded inwardly to a flat position to minimize the volume of the shelf unit when it is collapsed. When so folded, the shelf unit may be placed in a flat and thin shipping box to keep it collapsed, and when the shipping box is opened, the shelf unit expands outwardly under the natural stiffness of the materials of which it is made so that it is at least partially self-erecting. All the user must do is move the shelves into their horizontal positions and the shelf unit is automatically set up.

These and other objects and advantages of the invention will be apparent from the detailed description and drawings. In the description, reference is made to the accompanying drawings which illustrate a preferred embodiment of the invention.

BRIEF DESCRIPTION OF THE DRAWINGS

FIG. 11 is a view like FIG. 10 but of a second embodiment of a blank for the shelf, this embodiment having the tongues extending from the rear (when folded) edge of the reinforcing panel, and the reinforcing panel having tabs at its side edges which are folded up between the shelf support panel and the reinforcing panel to secure the dowel there between;

DETAILED DESCRIPTION OF THE PREFERRED EMBODIMENT

Figure 1:
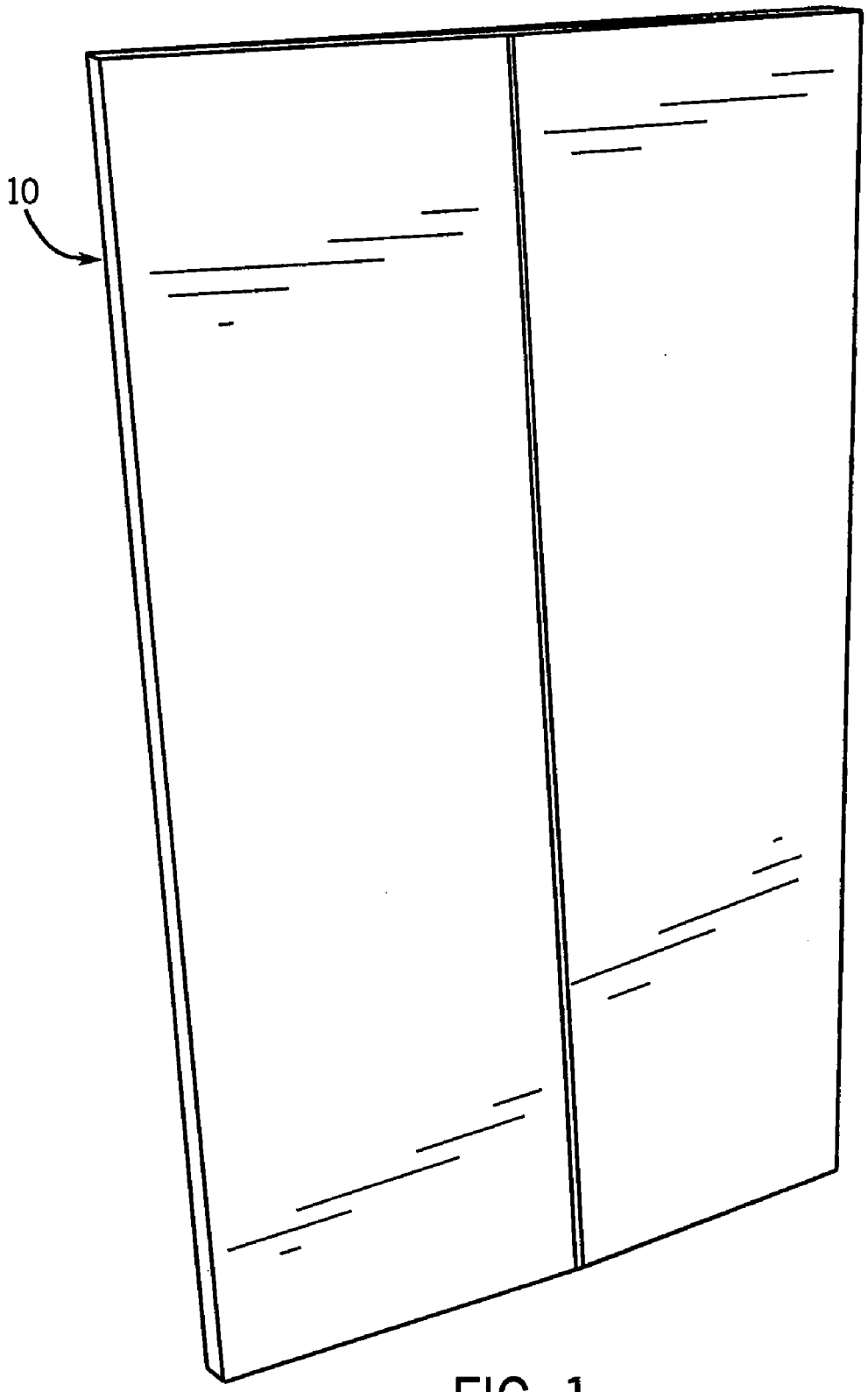
FIG. 1 is a view of a shipping container containing a collapsible shelf unit of the invention in its collapsed state.
Figure 2:
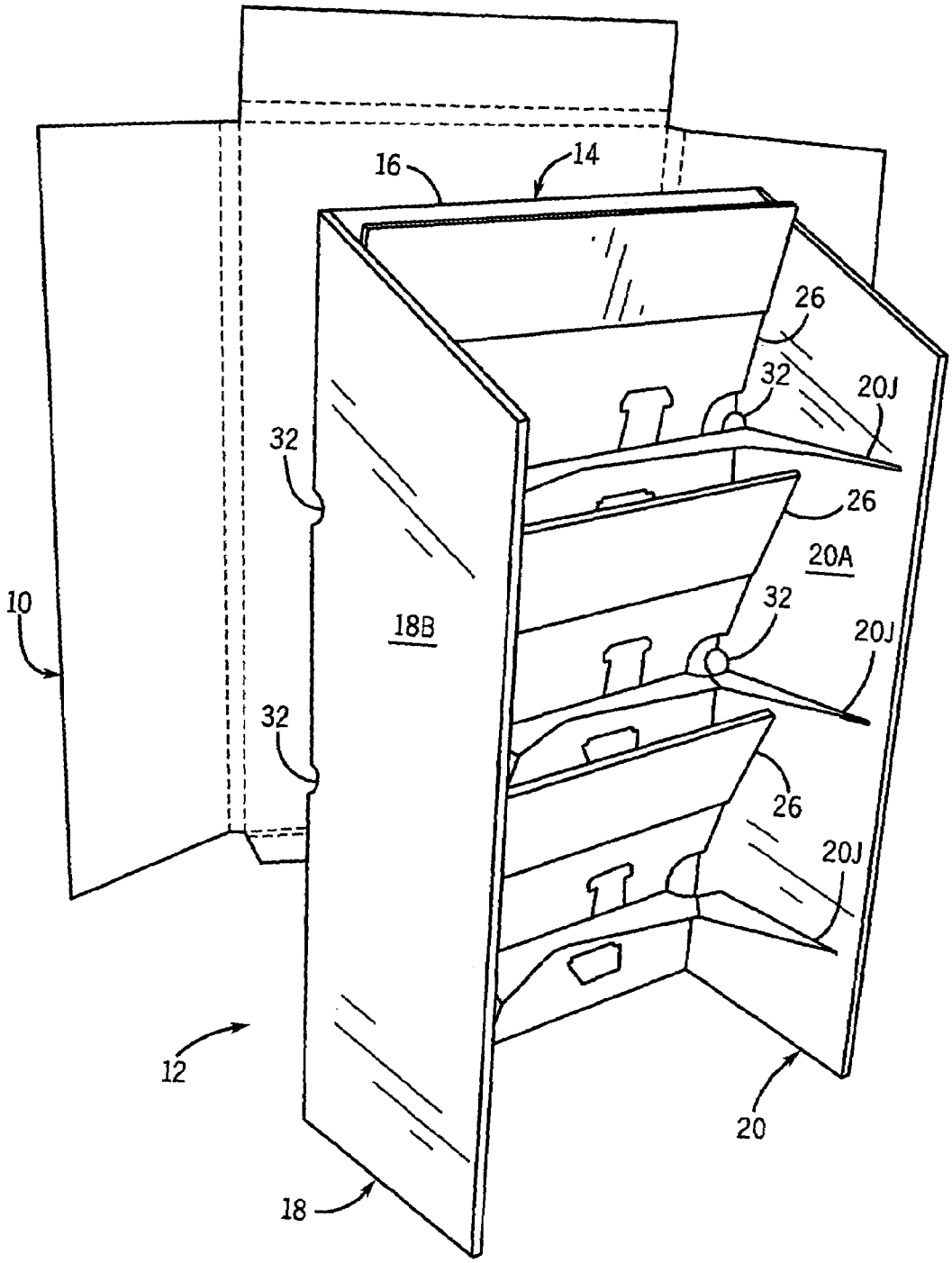
FIG. 2 is a view of the shipping container opened up with the shelf unit partially erected.
Figure 8:
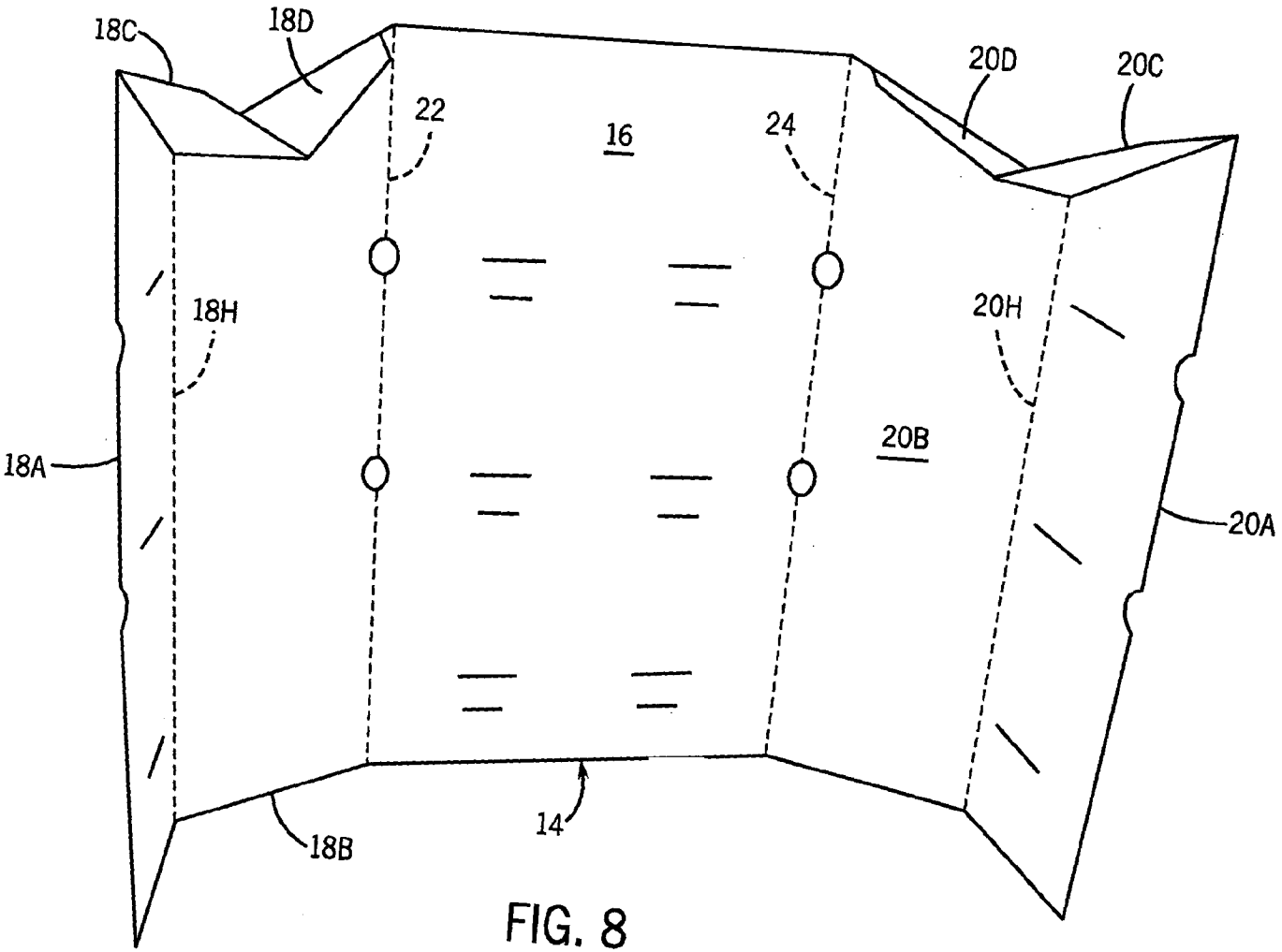
FIG. 8 is a view a blank for the frame partially folded to make the flame and prior to gluing.
Figure 9:
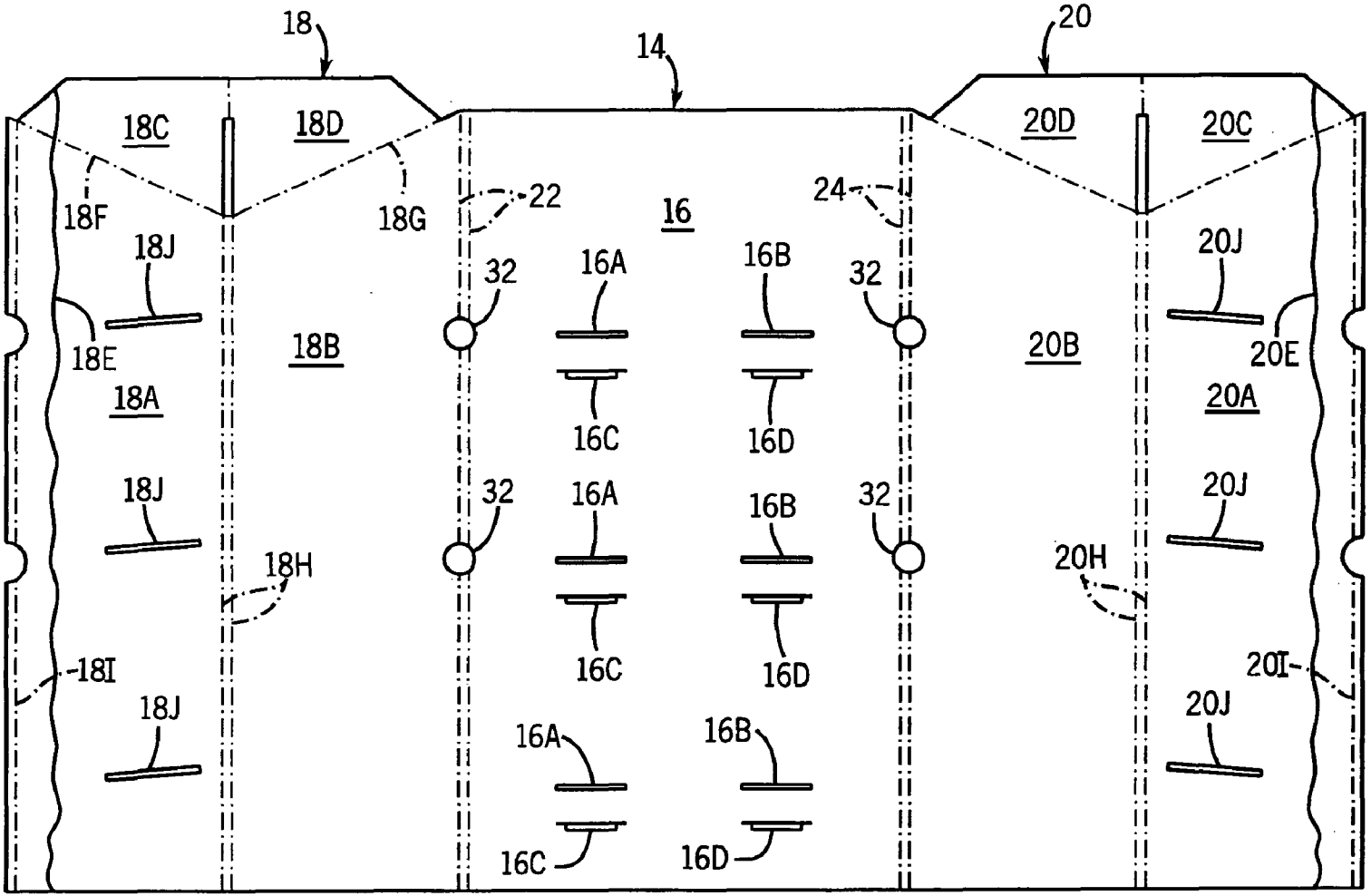
FIG. 9 is a view of the blank of FIG. 8 shown flat.

FIG. 1 illustrates a shipping box 10 which contains a shelf unit 12 (FIGS. 2 and 3) of the invention in its collapsed state. The shelf unit 12 includes a three sided frame 14 having a back 16 and opposed sides 18 and 20 hingedly attached to opposite side edges of the back 16 by score lines 22 and 24 (FIG. 8). Two of each of the score lines 22 and 24 slightly spaced apart may be provided in the back 18 as illustrated in FIG. 9 to facilitate folding of the sides 18 and 20 inwardly, since when so folded the shelves 26 are between the sides 18, 20 and the back 16. The width of each side 18, 20 is approximately one half of the width of the back 16, so that when the sides are folded inwardly, they do not overlap in the center of the back, to help keep the maximum folded thickness of the unit 12 as small as possible. However, the invention may also be practiced by making the sides 18, 20 wider so that they do overlap in the center.

Figure 3:
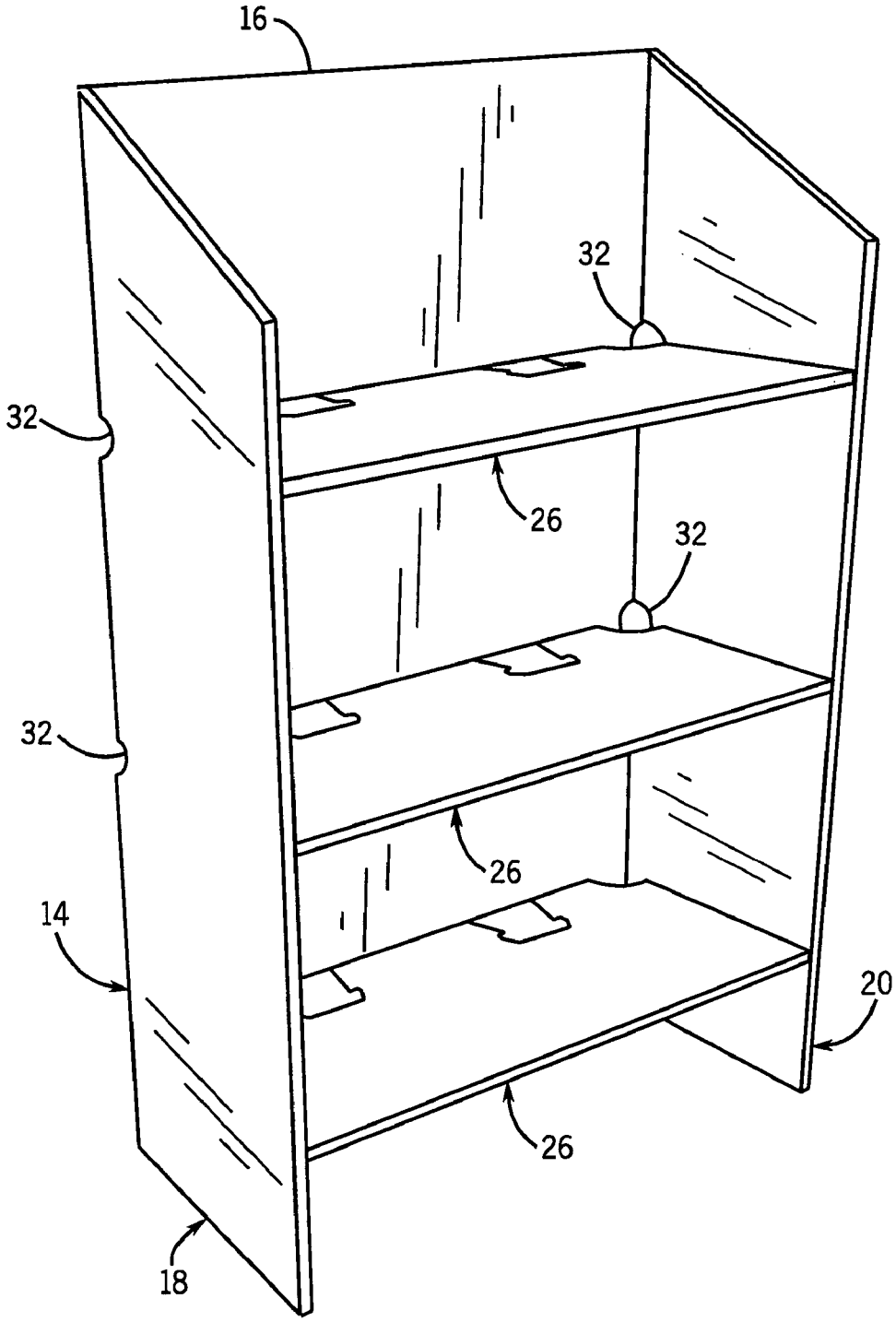
FIG. 3 is a view like FIG. 2 but of the shelf unit alone and with the shelf unit fully erected with the shelves folded into their erected positions.
Figure 4:
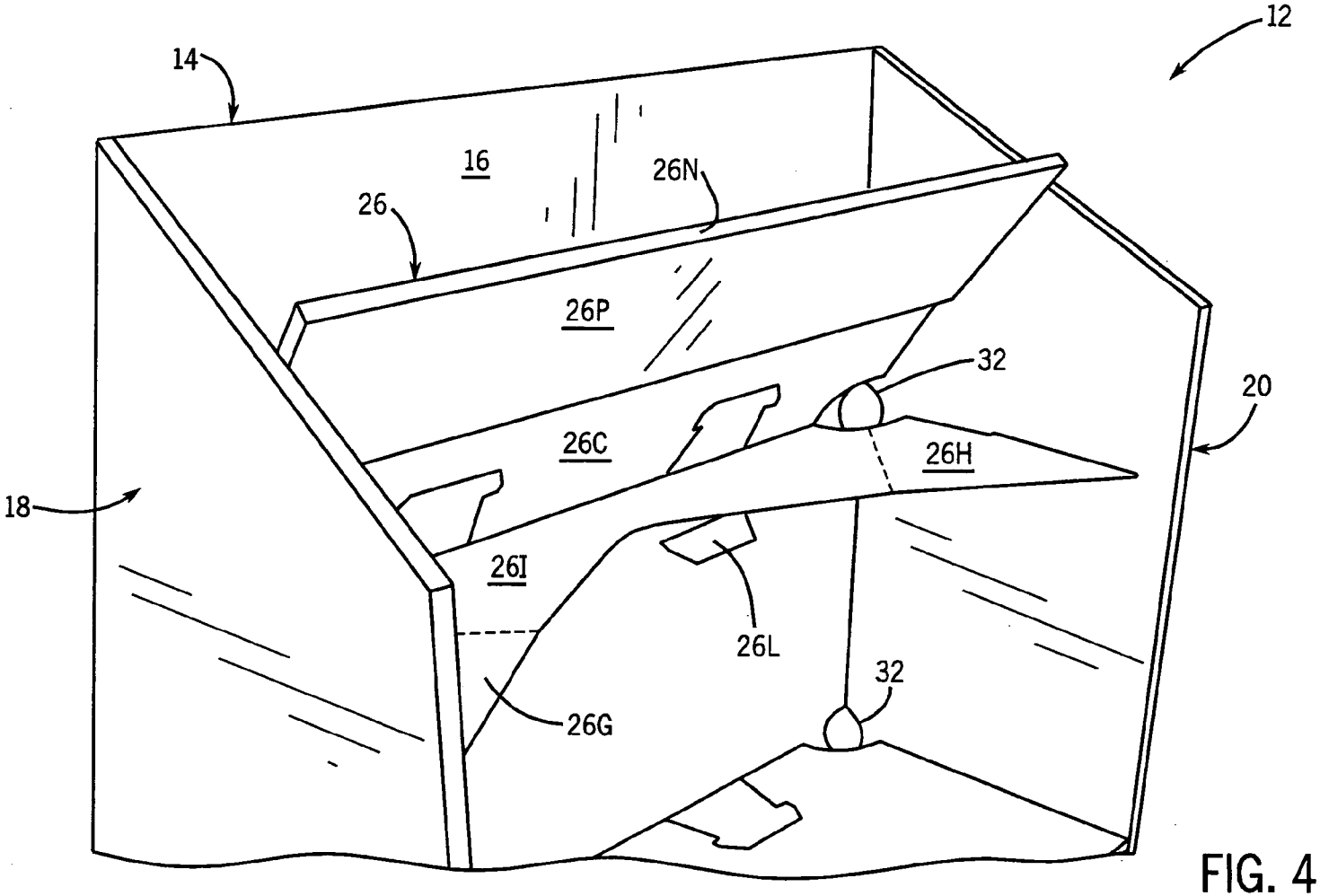
FIG. 4 is a detail perspective view of a portion of FIG. 2 showing one of the shelves being folded downwardly to its fully erect position.

As illustrated in FIGS. 8 and 9, the frame 18 is made from a single sheet of material which is folded to form the back 16 and sides 18 and 20. Both the back 18 and the three shelves 26 are preferably made from corrugated paperboard, for example ECT44B-250 B-flute single wall corrugated paperboard. The corrugations in the frame 18 run vertically (as viewed in FIG. 2) and the corrugations of each shelf run vertically as viewed in FIG. 10, so as to run parallel to the side walls 18 and 20 when the shelf unit is erect as shown in FIG. 3.

Referring to FIGS. 8 and 9, each of the side walls 18 and 20 is made of four panels 18A–D and 20A–D, respectively, which are folded relative to one another to create the side walls 18 and 20. The folding of each is the same so only the folding sequence for sidewall 18 will be described. Referring to FIG. 9, first a line of glue, for example hot glue, is applied in the area indicated by line 18E to the panels 18A and 18C, or in the case of side 20, in the area of line 20E to panels 20A and 20C. Then, in the case of the side 18, the panels 18C and 18D are folded downwardly along score lines 18F and 18G. This downward folding of the panels 18C and 18D causes panel 18A to be folded about score lines 18H so that the panels 18A and 18B are in a facing relationship with the glue line 18E holding the panel 18A against the face of panel 18B and also against panel 18C. As such the panels 18C and 18D are held folded against the faces of the respective panels 18A and 18B and against each other. The score line 18I (20I on the other side) is optional and need not be provided. Thereby, each of the sides 18 and 20 is two plies across most of its surface area, and four plies in the top portion, where the panels 18C and 18D or 20C and 20D reside.

Figure 10:
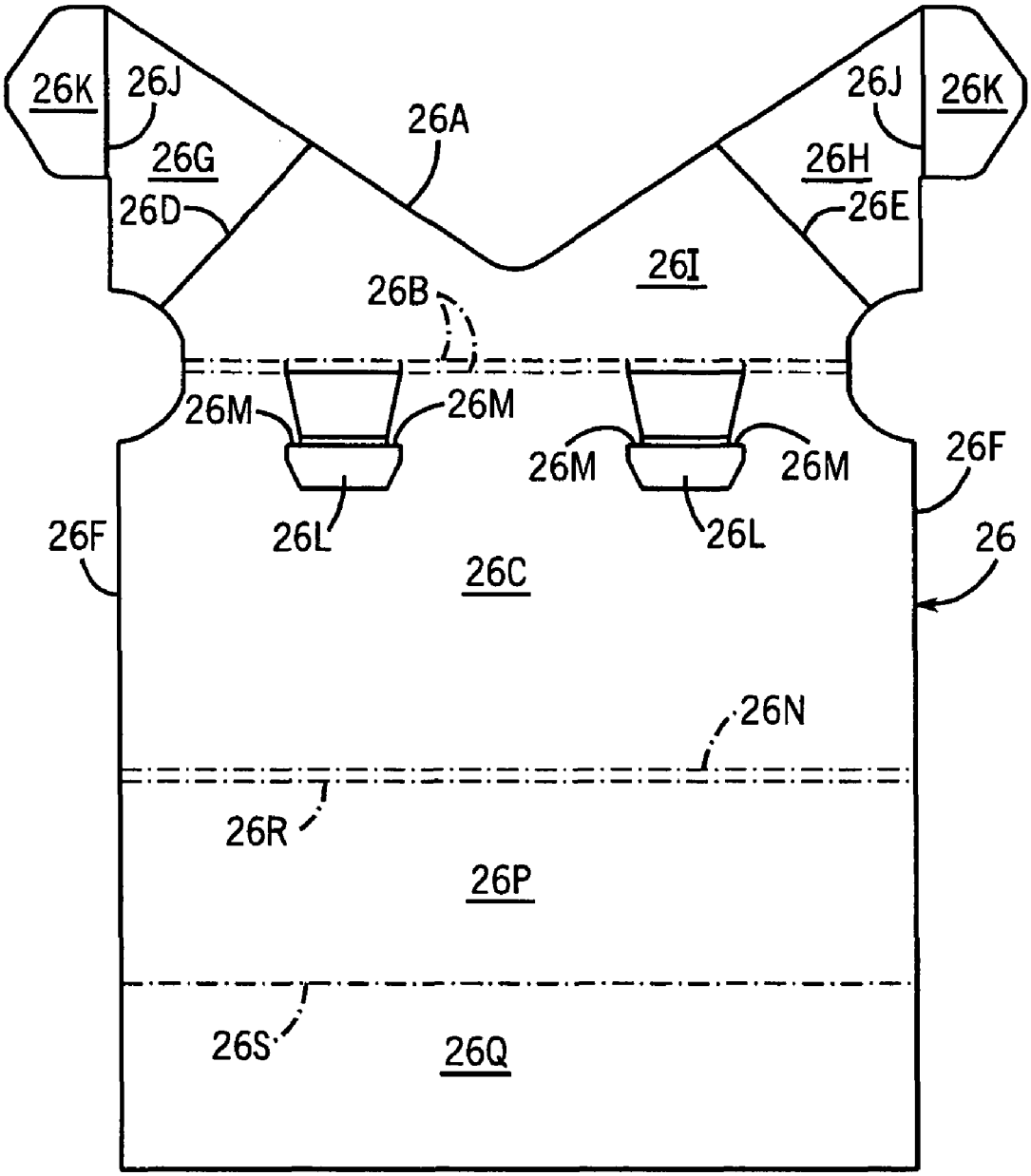
FIG. 10 is a plan view of a blank for a shelf for the unit of FIGS. 1–9 shown flat prior to folding and gluing.

Slots 18J and 20J are formed in the respective panels 18A and 20A for supporting the shelves 26 and slots 16A–D are formed in the back 16, also for supporting the shelves 26. Referring to FIG. 10, a blank for the shelf 26 has a base panel 26A hingedly connected by spaced score lines 26B to support panel 26C. Score lines 26D and 26E, which preferably are perforated score lines for easy folding, are at an approximately 45° angle to the side edges 26F (and to score lines 26B) and are directed at the rear corner between the adjacent side 18 or 20 and back 16 of the frame 14 when the shelf is positioned in its fully erect position as shown in FIG. 3. This corner is approximately where the score lines 26B and the side edges 26F would intersect if they were extended. As such, when the sides 18 and 20 of the frame 16 are folded inwardly, the score lines 26D and 26E move upwardly as they permit folding of wing panels 26G and 26H relative to the central panel 26I and ears 26K. After the sides 18 and 20 are folded all the way inwardly, the forward edges of the sides 18 and 20 meet or are slightly spaced apart in the middle of the back 16 and the shelves 26 are sandwiched between the sides 18 and 20 and the back 16.

A perforated score line 26J is also provided between each of the panels 26G or 26H and an ear 26K, one on each side of the base panel 26A. Each ear 26K is inserted into the adjacent slot 18J or 20J so that the ear 26K becomes sandwiched between the panels 18A and 18B or 20A and 20B. The perforated score line 26J also provides easy folding of the ears 26K relative to the panels 26G or 26H when the shelf unit is collapsed or erected, since the panels 26G or 26H fold upwardly relative to the ears 26K when the shelf unit is collapsed.

Figure 6:
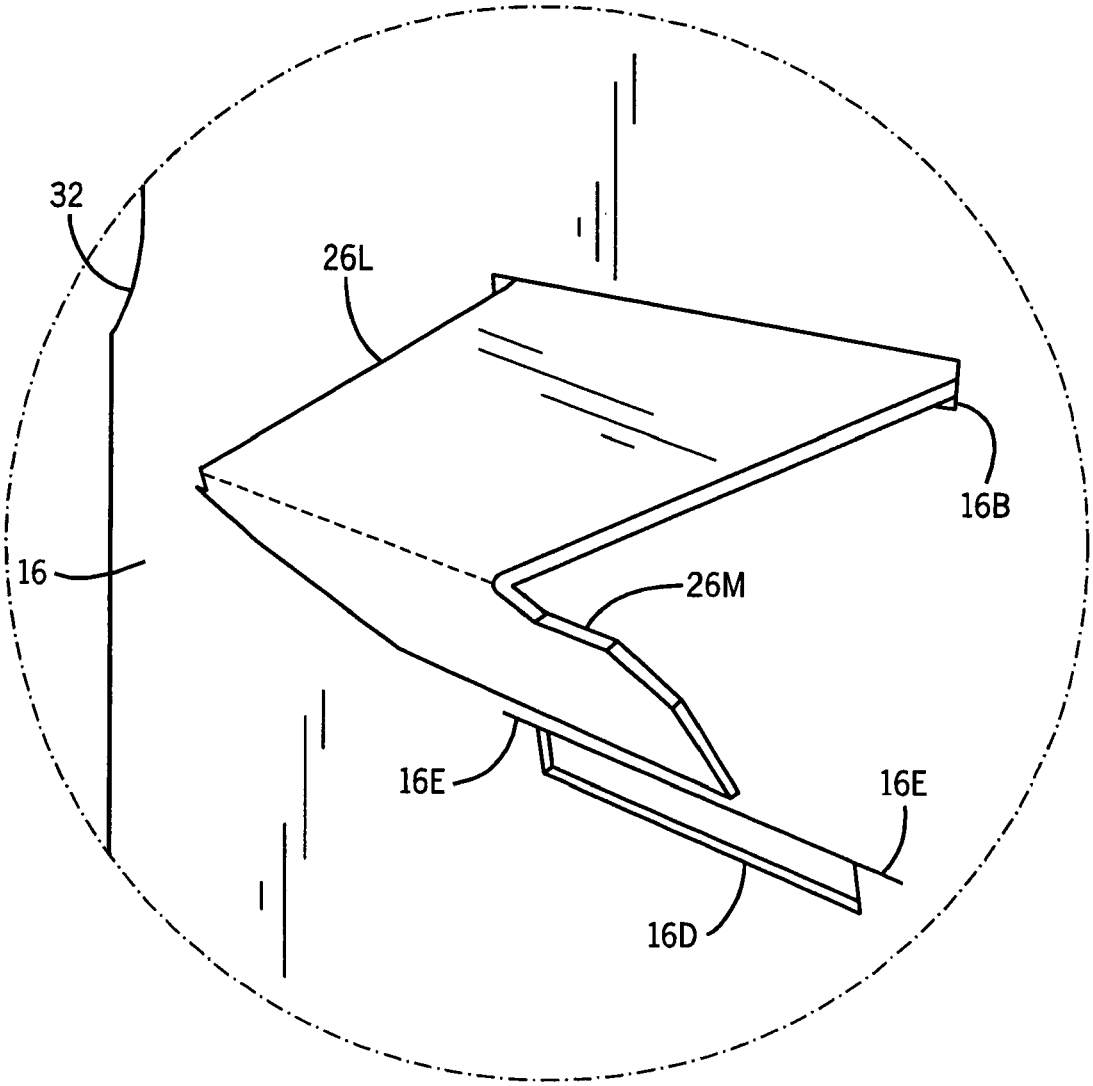
FIG. 6 is a detail view illustrating how the tongues, which are cut out of the support shelf panel of the shelf in this embodiment, are threaded into slots in the rear panel of the frame to secure the rear of the shelf to the frame.
Figure 7:
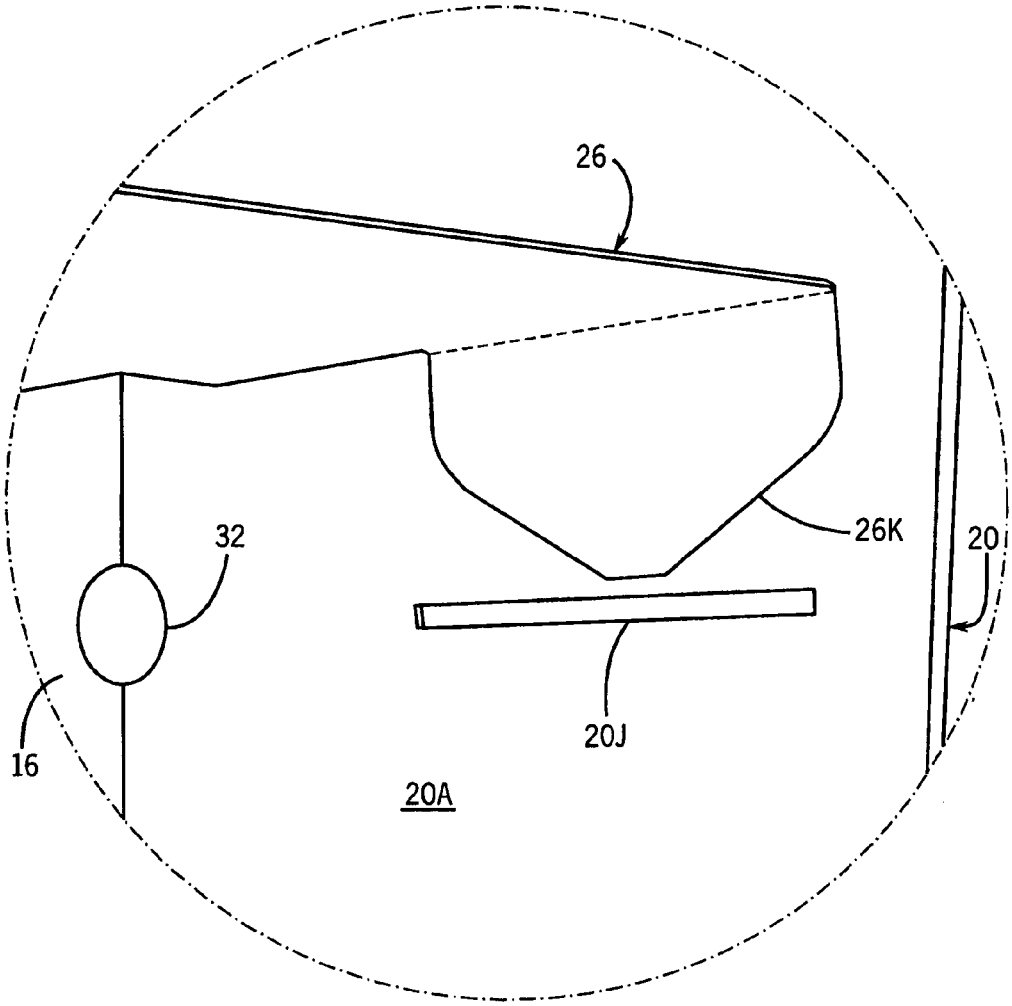
FIG. 7 is a view showing how ears of the base panel of the shelf are inserted into slots in the side of the frame.

Additional support, particularly for the rear edge of each shelf 26, is provided by tongues 26L which are cut out of the support panel 26C but remain hingedly attached to the base panel 26A at the score lines 26B. Tongues 26L are folded out of the plane of the panel 26C and are inserted into the adjacent slot 16A or 16B and, as shown in FIG. 6, are folded down around the rear of back 16 and reinserted into the slot 16C or 16D which is directly below the adjacent slot 16A or 16B to create a strap connection. The slots 16C and 16D may have a slit 16E which extends beyond the width of the slot 16D so as to permit insertion of the tongue 26L, which is wider that the slots 16C, 16D, so as to trap shoulders 26M of the tongue 26L to prevent the tongue 26L from becoming disengaged from the back 16.

Figure 5:
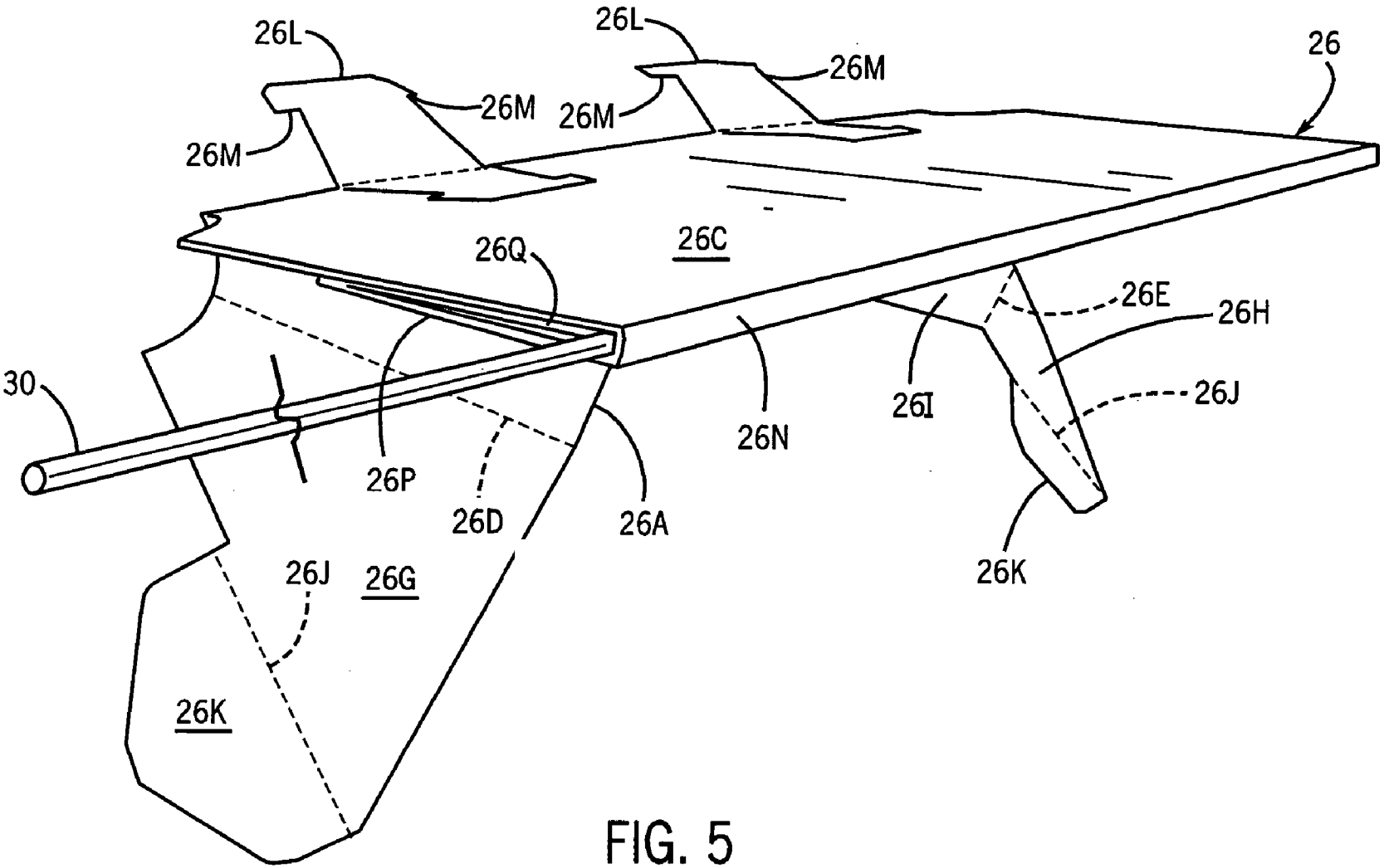
FIG. 5 is a view of one of the shelves alone and with a reinforcing dowel pulled partially out of the front edge of the shelf.

For reinforcement of the support panel 26C, a front edge panel 26N of narrow width is hingedly connected to the front edge of the support panel 26C and reinforcement panels 26P and 26Q are also hingedly connected to the front edge by respective fold lines 26R and 26S. Panel 26Q is folded 180° back onto panel 26P and panel 26P is folded 180° so as to position panel 26Q flat against the bottom of the support panel 26C. A line of glue, such as hot glue, is then applied to this interface between panel 26Q and the bottom of panel 26C to secure the reinforcing panels 26P and 26Q. As shown in FIG. 5, a reinforcement dowel 30 may be provided directly behind the front edge wall 26N to reinforce the front edge of the shelf 26, and the dowel may be made of wood, plastic, steel or other suitable material.

As best illustrated in FIG. 9, the slots 18J and 20J are inclined slightly rearwardly so that in the erected shelf unit they help keep product from falling off the shelf. Folding the shelves 26 down, from the position of FIG. 2 to the position of FIG. 3, maintains the spacing between the side walls 18 and 20 so that the shelf unit cannot be collapsed while the shelves are in the generally horizontal positions of FIG. 3. The shelves 26 must first be moved into the generally vertical positions of FIG. 2 by folding them upwardly relative to panel 26I along score lines 26B to which the tongues 26L are connected, so that they are against the back 16. Then, folding the sides 18 and 20 inwardly toward one another automatically pivots the panels 26G and 26H upwardly relative to the ears 26K about score lines 26J. At the same time, score line 26D permits folding of the panels 26G and 26H relative to the panel 26I as the panel 26I is hinged upwardly relative to the tongues 26L so that the panel 26I is pushed up against the bottom of the support panel 26C and the panels 26G and 26H are folded backwardly so as to overly the panel 26I when the shelf unit is fully collapsed. The circular cutouts 32 provided in the rear corners of the frame 14 provide for clearance with the front corners of the lower two shelves 26 when the shelf unit is fully collapsed. Therefore, these reduce the tendency of the shelf unit to spring open excessively.

Figure 11:
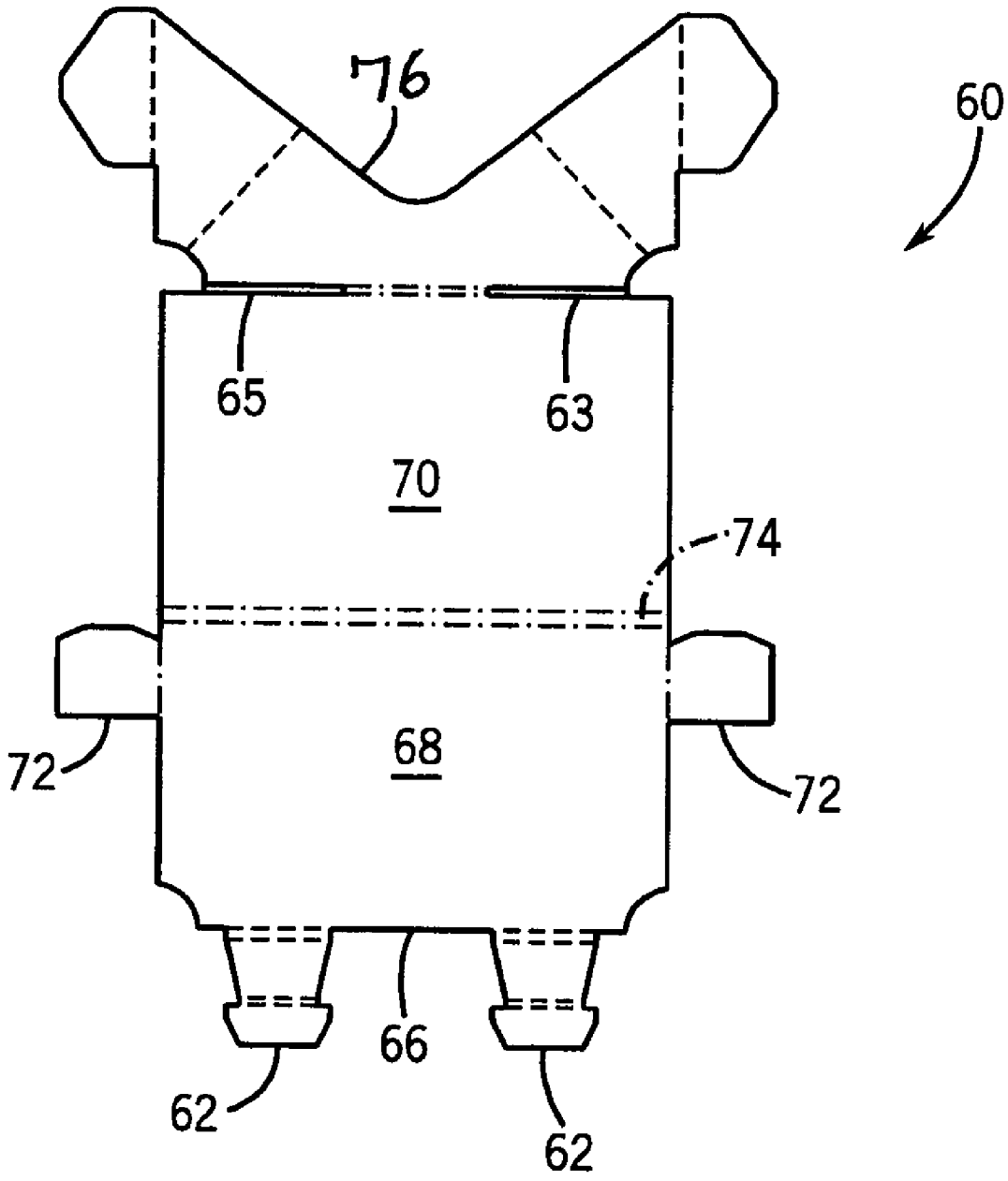
Figure 14:
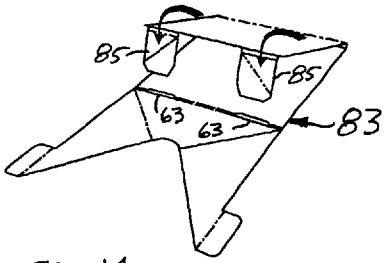
FIG. 14 is a perspective view of a third embodiment of a shelf that is for use with the frame of FIGS. 12 and 13, with a first folding step underway.
Figure 13:
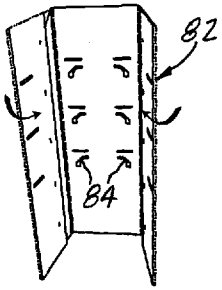
FIG. 13 is a view like FIG. 12 with the side panels folded in and adhered.
Figure 12:
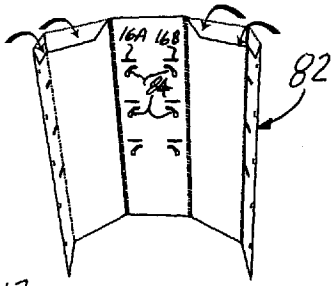
FIG. 12 is a view like FIG. 8 of a third embodiment.
Figure 17:
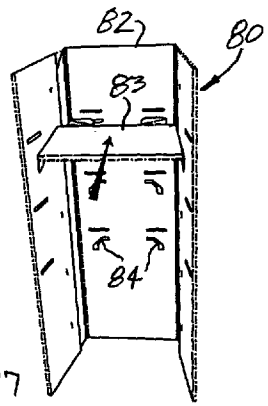
FIG. 17 is a perspective view of the shelf of FIG. 16 being assembled to the frame of FIG. 13.
Figure 16:
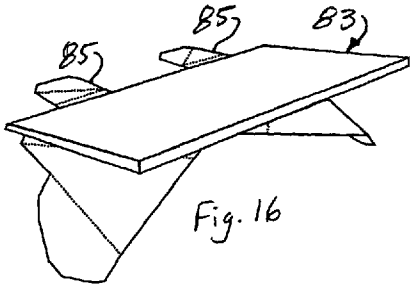
FIG. 16 is a perspective view from the top of the shelf of FIGS. 14 and 15 with is ready to be assembled to the frame of FIG. 13.
Figure 15:
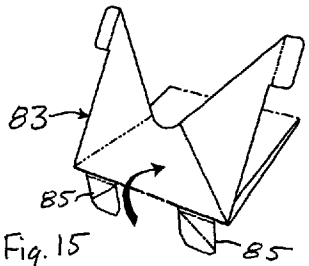
FIG. 15 is a perspective view from the bottom of the shelf of FIG. 14 with a second folding step underway.
Figure 19:
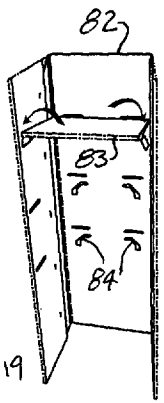
FIG. 19 is a front perspective view of the shelf side supports being tucked into slots in the sides of the frame.
Figure 18:
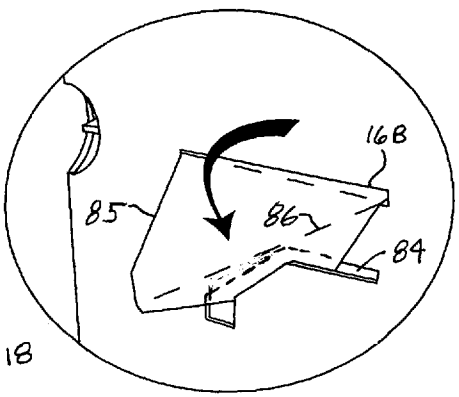
FIG. 18 is a detail perspective view of the back of the frame and shelf of FIG. 17 illustrating a tab of the shelf being tucked into slots in the rear panel of the frame.

FIG. 11 illustrates an alternate embodiment of a blank 60 for making a shelf for the unit. The blank 60 is substantially the same as the blank shown in FIG. 10, except that the tongues 62 extend from the rear (when folded) edge 66 of the reinforcing panel 68, which is folded back under the shelf support panel 70 to underlie the panel 70 when the shelf is folded. The tongues 62 extend through slots 63 which are provided in the folded area of the shelf between the panel 70 and the base panel 76, and are engaged in slots 16B and 16D in the rear wall of the frame 14 as described above. Tabs 72 along the sides of the panel 68 are folded in so they are between the panels 68 and 70 when they're folded, so that the tabs 72 keep a reinforcing dowel in place when it is placed between the two panels 68 and 70, adjacent to the front edge 74 of the shelf. The base panel 76 is substantially the same as the base panel in FIG. 10. This construction provides a smooth upper surface on the shelf support panel 70, since the tongues are not cut out of it.

FIGS. 12–19 illustrate a third embodiment 80 of a shelf unit of the invention. The shelf unit 80 is substantially the same as the previously described embodiments, except as illustrated or described. The main difference is in the shape of the slots 16C and 16D and in the tongues 62 (FIG. 11). In the embodiment 80, rather than slots like 16C and 16D of the frame 14, the frame 82 has slots 84 which have three slot sections, with the central slot section truncating the corner at an angle (approx. 45°) between the two end slot sections, which are at 90° to one another with one horizontal and one vertical. This enables the corner of the generally rectangular tongues 85 to be tucked into the slots 84 to hold the tongues 85 generally flat against the back wall of the frame 82. The tongues 84 may also each have a diagonal score 86 to enable a small fold to be made to facilitate insertion of the tongues 85 into the slots 84. The shelf 83 of the third embodiment also lacks the tabs 72 of the second embodiment.

Preferred embodiments of a collapsible shelf unit of the invention have been described in considerable detail. Many modifications and variations to the preferred embodiment described will be apparent to those skilled in the art. For example, the shelf unit could be made of materials other than corrugated paperboard, and it may be possible to attach the shelf units to the frame by means other than those specifically described. Therefore, the invention should not be limited to the embodiment described, but should be defined by the claims which follow.

I claim:

1. A collapsible shelf unit, comprising:

a three-sided frame, said frame having a back and opposed sides hingedly connected to said back at opposite edges of said back;

a base panel which is hingedly connected at opposite side edges of said base panel to an adjacent side of said frame, said base panel having wing portions which are hingedly connected to a central portion of said base panel; and at least one support panel hingedly connected to said frame;

wherein each support panel can be folded downwardly relative to said base panel to expand and hold said sides of said frame in an erect position, and said support panel can be hinged upwardly against said back of said frame and said sides of said frame folded inwardly toward one another to collapse said central portion of said base panel toward said back of said frame so as to permit folding said shelf unit into a generally flat collapsed state.

2. A collapsible shelf unit as claimed in claim 1, wherein said shelf further includes at least one reinforcing panel beneath at least a portion of said support panel.

3. A collapsible shelf unit as claimed in claim 1, wherein said shelf includes a reinforcement dowel adjacent to a front edge of said shelf.

4. A collapsible shelf unit as in claim 1, wherein said base panel is hingedly connected to said sides of said frame by ears at side edges of said base panel which are received in slots in said sides of said frame.

5. A collapsible shelf unit as in claim 1, wherein said base panel is hingedly connected to said back of said frame by tongues which are hingedly connected to a rear edge of said base panel.

6. The collapsible shelf unit of claim 5, wherein said tongues are cut out of said support panel.

7. The collapsible shelf unit of claim 5, wherein said tongues extend through slots in said back of said frame.

8. The collapsible shelf unit of claim 7, wherein said tongues have ends which define shoulders and are reinserted into slots below said aforementioned slots in said back of said frame, said slots being of a lesser width than said shoulders so as to trap said shoulders on a front side of said back of said frame.

9. A collapsible shelf unit as in claim 1, wherein said base panel is hingedly connected to said back of said frame by tongues which extend through slots in said back of said frame.

10. The collapsible shelf unit of claim 9, wherein said tongues are hingedly connected to a rear edge of a reinforcement panel which underlies said support panel.

11. The collapsible shelf unit of claim 10, wherein said tongues extend through slots in said shelf and through said slots in said back of said frame.

12. The collapsible shelf unit of claim 11, wherein said tongues have ends which define shoulders and are reinserted into slots below said aforementioned slots in said back of said frame, said slots being of a lesser width than said shoulders so as to trap said shoulders on said front side of said back of said frame.

13. The collapsible shelf unit of claim 9, wherein said tongues are reinserted into slots below said aforementioned slots in said back of said frame, said slots including at least three slot sections, with one of said slot sections truncating a corner between two of said slot sections.

14. The collapsible shelf unit of claim 1, further comprising a shipping container, and wherein said shelf unit is collapsed and contained in said shipping container.

* * * * *